US006569258B2

(12) United States Patent
Clifford et al.

(10) Patent No.: US 6,569,258 B2
(45) Date of Patent: May 27, 2003

(54) METHOD AND APPARATUS FOR CLEANING A BELL ATOMIZER SPRAY HEAD

(75) Inventors: Scott J. Clifford, Rochester Hills, MI (US); Donald S. Bartlett, Troy, MI (US); Michael G. Beem, Sterling Heights, MI (US)

(73) Assignee: FANUC Robotics North America, Inc., Rochester, MI (US)

( * ) Notice: Subject to any disclaimer, the term of this patent is extended or adjusted under 35 U.S.C. 154(b) by 0 days.

(21) Appl. No.: 09/924,691

(22) Filed: Aug. 8, 2001

(65) Prior Publication Data

US 2002/0170580 A1 Nov. 21, 2002

Related U.S. Application Data

(60) Provisional application No. 60/291,234, filed on May 16, 2001.

(51) Int. Cl.[7] ..... B08B 3/02

(52) U.S. Cl. ..... 134/36; 134/38; 134/102.1; 134/102.2

(58) Field of Search ..... 134/36, 38, 22.11, 134/102.1, 102.2

(56) References Cited

U.S. PATENT DOCUMENTS

| | | | | |
|---|---|---|---|---|
| 5,072,377 A | | 12/1991 | Samburg | |
| 5,072,881 A | * | 12/1991 | Taube, III | 239/8 |
| 5,122,192 A | | 6/1992 | Inukai et al. | |
| 5,947,377 A | | 9/1999 | Hansinger et al. | |
| 6,341,734 B1 | * | 1/2002 | Van Der Steur | 239/223 |

* cited by examiner

*Primary Examiner*—Zeinab El-Arini
(74) *Attorney, Agent, or Firm*—MacMillan, Sobanski & Todd, LLC

(57) ABSTRACT

A cleaning system and method for a bell atomizer spray head provides an air/solvent mixture to an exterior surface of a bell cup through shaping air passages and outlets during a color change or bell cleaning operation. In the alternative, cleaning passages can be provided for the air/solvent mixture to exit adjacent the bell cup exterior.

12 Claims, 3 Drawing Sheets

METHOD AND APPARATUS FOR CLEANING A BELL ATOMIZER SPRAY HEAD

CROSS-REFERENCE TO RELATED APPLICATION

This application claims the benefit of U.S. provisional patent application Ser. No. 60/291,234 filed May 16, 2001.

BACKGROUND OF THE INVENTION

The present invention relates generally to automated spray painting or coating equipment and, in particular, to a novel cleaning system and method for a bell atomizer spray head.

In spray painting of various types of products, such as for example automobiles or automobile parts, automated machinery has been developed to spray a succession of parts in a continuous and rapid manner. Many applications use a variety of different types and colors of paint supplied to the same application devices (i.e. rotary atomizers and spray guns). In many of these applications, successive automobiles or parts therefore are to be painted a different color. In order to accomplish this color change, it is necessary to quickly clean and purge the paint supply lines leading to the applicators so as to avoid intermixing of the different colors. Often a single color paint is applied, such as a clear coat applied over the color base coat, and also requires periodic cleaning to remove any undesirable accumulation of paint.

Typical rotary atomizing coating devices have bell cups over which the paint flows and which are rotated at high speeds normally between 10,000 and 70,000 rpm. The electrostatically charged paint is fed to an inner chamber of the rotating bell cup where it is centrifuged forwardly through chamber openings to the larger diameter outer edge of the cup and is broken up into atomized particles as it escapes the bell cup edge. The axial centerline of the rotating bell cup is directed toward an electrically grounded workpiece which is to be coated. Because the atomized particles are centrifuged in a direction perpendicular to the axial centerline of the bell cup, it is known in prior art devices to redirect these particles so that they move toward the workpiece. In some situations, the electrostatic charge held by the atomized coating particles is sufficient to attract the particles to the grounded workpiece. It is also known in prior art rotary application devices to supply a cylindrically shaped curtain of shaping air which also directs the particles toward the workpiece. The shaping air is typically routed through passages within the atomizer housing and is supplied through a ring of holes or slots in a shaping air collar outboard of the bell cup. The shaping air also controls the diameter of the spray particle pattern.

During a color change, the interior and exterior of the bell cup, as well as the paint supply passages, must be cleaned and purged prior to introducing the next color into the system. Periodic cleaning of the bell cup is also required for single color paint systems to keep paint from drying on the cup. From the U.S. Pat. No. 5,072,881, a method is known to clean automated paint spraying equipment wherein an adjustable ratio mixing valve is utilized to intermix solvent and compressed air, which intermixed solvent and air is then routed through the manifolds and supply lines of the painting equipment.

Prior art methods for cleaning the atomizing bell cups consist typically of a single stream of a liquid only, typically a solvent, that is sprayed at the edge of the bell cup or introduced into a well in the back of the bell cup. These prior art methods also consume a higher amount of solvent when compared to using the above-mentioned solvent and air mixture. It is becoming increasingly necessary to use and expel a lesser amount of solvent, due to greater scrutiny and regulation by various governmental agencies. In addition, these prior art methods do not accomplish cleaning the shape air holes or cleaning of the face of the shaping air collar. It is also undesirable to have the front face cleaned manually because the paint can be inadvertently pushed into the shape air holes.

It is desirable to provide an apparatus and method to clean and purge the interior and exterior portions of the atomizing bell cup as well as the paint manifold when changing paint colors. It is also desirable to provide an apparatus and method to clean the shaping air holes and collar while reducing the amount of solvent required for the bell atomizer cleaning process. Furthermore, by cleaning the front face automatically, defects caused by dry particulate accumulating on the front face of the shape air ring are not expelled onto the part.

SUMMARY OF THE INVENTION

The present invention concerns a cleaning system and method for a bell atomizer spray head and fluid delivery system. A rotary atomizer spraying system includes a fluid manifold with a pump means, a compressed air supply, and a solvent supply attached thereto. An outlet of the pump means extends to a spray head having a shaping air manifold and shaping air passages included therein. The air and solvent supplies are connected to the paint manifold, the pump means and the spray head. During a color change sequence, the present invention injects a mixture of air and solvent into the shaping air manifold from which it proceeds to exit the shaping air holes and impact the exterior of the bell. In this way the shaping air manifold and passages, the shaping air holes, and the exterior of the bell cup are cleaned simultaneously. The solvent and air mixture can also be used to clean the injector and the insides of the bell cup. The shaping air passages are designed so that dead space is minimized, so the solvent and air remain a mixture, and so that liquid droplets cannot coalesce and later release in an undesirable point in the coating process. The solvent and air mixture significantly reduces the amount of solvent required for the cleaning process.

Alternatively, the solvent and air mixture can also be separately ported into a single or a plurality of holes independent of the shaping air system and used separately or in conjunction with the prior claims to clean the outside of the bell cup.

In addition, the present invention can be embodied advantageously in a handheld spray gun. The solvent and air mixture can be injected into the fan or shaping air ports of the spray gun.

DESCRIPTION OF THE DRAWINGS

The above, as well as other advantages of the present invention, will become readily apparent to those skilled in the art from the following detailed description of the preferred embodiments when considered in the light of the accompanying drawings in which.

DESCRIPTION OF THE PREFERRED EMBODIMENTS

Figure 1:
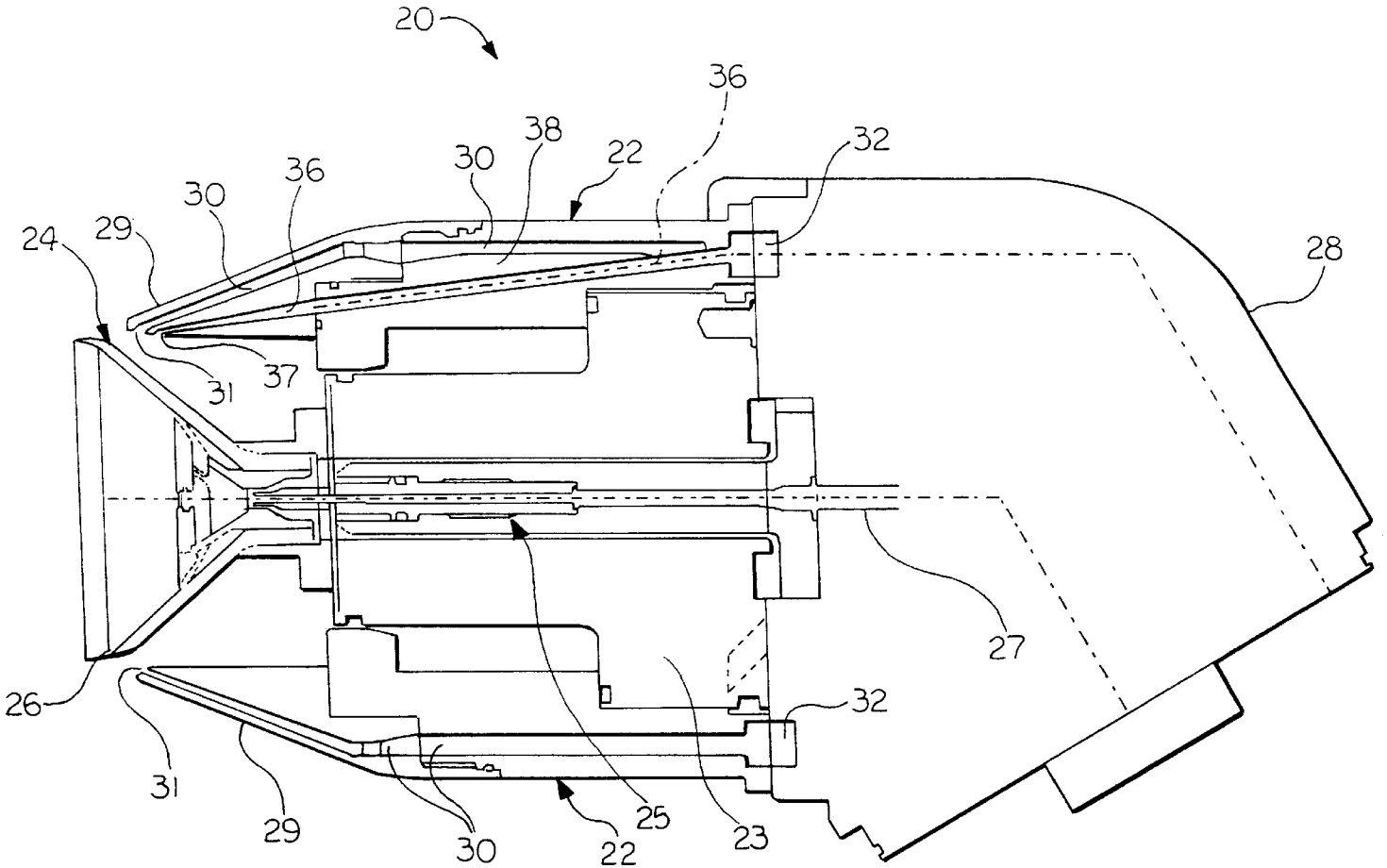
FIG. 1 is a side elevation view in partial cross section of a bell atomizer spray head according to the present invention.

Referring now to FIG. 1, a bell atomizer spray head is indicated generally at 20 adapted to be mounted at the end of a robot arm. The bell atomizer spray head 20 includes a generally cylindrical outer cover or housing 22 that encloses a drive motor 23 such as magnetic air bearing turbine. The turbine 23 drives in rotation a generally frustroconical atomizing bell cup 24 positioned in an open end of the cover 22. The atomizing bell cup 24 is supplied with paint through a central opening connected to a fluid injector 25 that extends through the turbine 23. When the atomizing bell cup 24 is rotated by the turbine 23 and paint is supplied through the injector 25 through a supply line 27, a fluid stream (not shown) enters the center of the bell cup and covers an interior surface flowing to an outer edge 26 where the paint is released into the surrounding air in atomized form.

The spray head 20 is connected to a robot wrist 28 through which the supply line 27 extends. The robot wrist 28 may be angled, as shown, or it may be a straight connector (not shown.) The robot wrist 28 is typically attached to a robot arm (not shown). The supply line 27 can be connected to a paint supply, such as a canister (not shown) carried by the robot arm. Alternatively, the supply line 27 is connected to a remote manifold (not shown) connected to storage tanks of a single type of or different color paints.

Attached to a forward end of the cover 22 is a generally tubular shaping air assembly 29 that terminates adjacent an outer surface of the bell cup 24 near the outer edge 26 thereof. A plurality of shaping air passages 30 are formed in the assembly 29 each having at one end a hole or slot outlet 31 facing the outer surface of the bell 24 and directed toward the edge 26. The shaping air passages 30 are connected to a shaping air supply line 32 that extends through the robot wrist 28 to a shaping air supply (not shown) providing pressured air. The shaping air exiting the outlets 31 directs the atomized paint in a desired pattern toward the object to be painted.

As explained below, during a color change or bell cup cleaning operation the method and apparatus according to the present invention supplies a cleaning solvent and air mixture to the shaping air internal manifold or supply line 32 for the purpose of cleaning the outer surface of the atomizing bell cup 24 while simultaneously cleaning the shaping air outlets 31. Such a cleaning method significantly reduces the amount of solvent required to clean the exterior of the bell cup 24.

In an alternative embodiment, at least one cleaning passage 36, and preferably a plurality in a ring, is connected between the shaping air supply line 32 and an outlet 37. The cleaning passage 36 is formed through a manifold 38 in the atomizer housing 22 through which manifold the shaping air passages 30 also are formed. The cleaning passage 36 is independent of the shaping air passages 30 and is supplied with the mixture of compressed shaping air and solvent during the color change sequence. The air and solvent mixture is released from the outlet 37 to clean the outer surface of the atomizing bell cup 24. Through proper valving, the air and solvent mixture can be supplied to both of the passages 30 and 36, or only the passage(s) 36.

Figure 2:
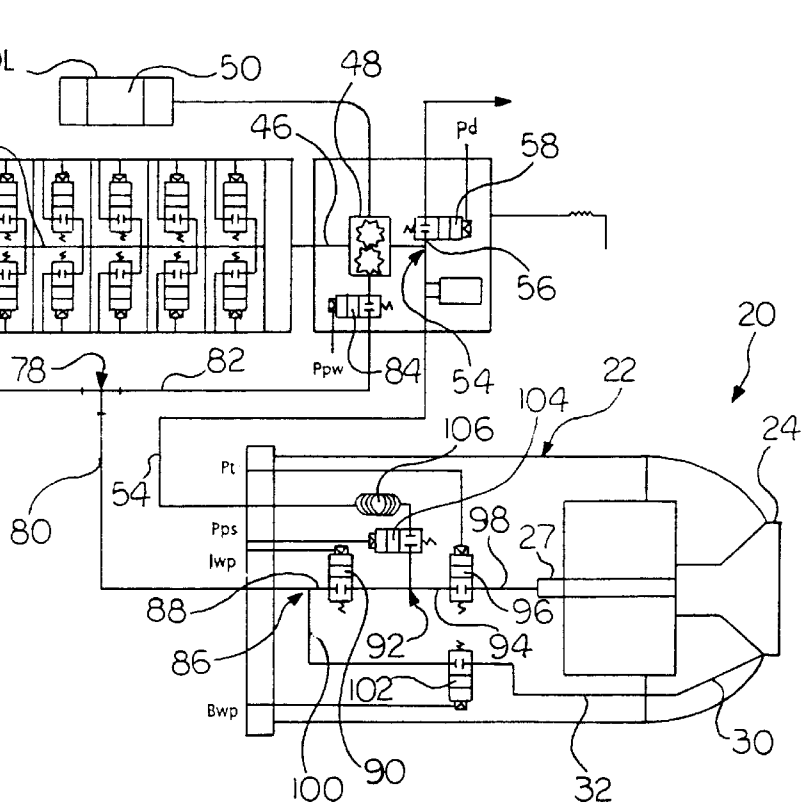
FIG. 2 is a schematic representation of the bell atomizer spray head shown in the FIG. 1 connected to a first embodiment fluid delivery system.

Referring now to FIG. 2, a first embodiment of a fluid delivery system is shown generally at 39. The fluid delivery system 39 includes a fluid manifold housing 40 having a single or plurality of fluid valves 42. Each fluid valve 42 includes an inlet that is connected to a fluid supply (not shown), which preferably corresponds to a type of paint to be used in coating the various workpieces, and an outlet 44. The outlets 44 of the fluid valves 42 are connected to a color changer supply line 46. The color changer supply line 46 is connected at one end of the fluid manifold housing 40 to an inlet of a pump means 48, which is powered and controlled by a control means 50. The pump means 48 is preferably a gear pump. Alternatively, the pump means 48 is any type of positive displacement or centrifugal pump. An outlet of the pump means 48 is connected to a tee coupling 52 branching to a fluid line 54 that extends to an inlet of the spray head 20, for supplying fluid to fluid injector. Another fluid line 56 branches from the tee 52 to an inlet of a dump valve 58. An outlet of the dump valve 58 preferably extends to a fluid reclamation system (not shown). An actuating signal Pd is provided to control the dump valve 58. The actuating signal Pd is preferably compressed air from a controller (not shown).

The fluid manifold housing 40 contains a solvent valve 60 actuated by a signal Psol to open and close the valve. An inlet of the solvent valve 60 is connected to a pressurized supply of solvent (not shown), preferably in the range of 95 to 250 pounds per square inch (psi). An air valve 62 is also mounted in the fluid manifold housing 40 and is actuated by a signal Pa to open or close the valve. An inlet of the air valve 62 is connected to a supply of compressed air (not shown), preferably in the range of 75 to 85 psi. An outlet of the solvent valve 60 is connected to an inlet of a solvent injection flow controller 64. The flow controller 64 regulates the amount of solvent injected when a color change sequence, outlined in more detail below, is initiated.

An outlet of the flow controller 64 connects to a common cleaning line 68. An outlet of the air valve 62 is also connected to the cleaning line 68. Because the pressurized solvent is preferably at a higher pressure than the compressed air, the solvent will always be able to flow into the cleaning line 68 regardless of the pressure of the compressed air in the cleaning line 68. The cleaning line 68 extends to a branch of a tee coupling 70 having another branch 72 connected to an inlet of a color changer valve 74. An actuating signal Pcc is provided to open and close the color changer valve 74. An outlet of the color changer valve 74 connects to the color changer supply line 46. A cleaning line 76 is connected to a stem of the tee 70 and to an inlet of a solvent control 77. The solvent control 77 includes a pressure sensor and generates the Psol signal only when proper airflow is present.

The cleaning line 76 extends to a branch of another tee coupling 78 which has a stem 80 connected to a fluid inlet of the spray head 20, and another branch 82 connected to an inlet of a pump wash valve 84. An actuating signal Ppw is provided to open and close the pump wash valve 84. An outlet of the pump wash valve 84 is connected to another inlet of the pump means 48. The actuating signals Psol, Pa, Pcc, and Ppw are preferably supplied by compressed air which provides pressure to a diaphragm (not shown) of an actuator of the valves 60, 62, 74, and 84. The compressed air for the actuating signals Psol, Pa, Pcc, and Ppw may be from the same supply of compressed air for the air valve 62, or the compressed air supply may be a separate system.

The stem 80 of the tee coupling 78 connects to a branch of a tee coupling 86 within the atomizer housing 22 having another branch 88 connected to an inlet of an injector wash valve 90. An actuating signal Iwp is provided to open and close the injector wash valve 90. The outlet of the injector wash valve 90 connects to a branch of another tee coupling 92 with another branch 94 extending to an inlet of a trigger valve 96. An actuating signal Pt is provided to open and close the trigger valve 96. An injector line 98 from an outlet of the trigger valve 96 connects through the paint supply line 27 to the atomizing bell cup 24. A stem 100 of the tee 86 extends to an inlet of a bell wash valve 102. An actuating signal Bwp is provided to open and close the bell wash valve 102. An outlet of the bell wash valve 102 connects to the shaping air supply line 32 and the shaping air passages 30 for washing an outer surface of the atomizing bell cup 24 with the air and solvent mixture. Alternatively, the outlet of the bell wash valve 102 is connected to the cleaning passages 36 for washing an outer surface of the atomizing bell cup 24. The actuating signals Iwp, Pt, and Bwp are preferably supplied by compressed air.

The fluid line 54 that attaches to the spray head 20 connects to an inlet of a fluid supply valve 104 within the atomizer housing 22. An actuating signal Pps is provided to open and close the fluid supply valve 104. An outlet of the fluid supply valve 104 extends to a stem of the tee 92. The fluid supply valve 104 supplies paint to the paint supply line 27 during a painting operation. Optionally, a paint hose coil 106 is provided at the fluid line 54 to reduce the occurrence of electrostatic faults. The actuating signal Pps is preferably supplied by compressed air to control the fluid supply valve 104 in order to provide paint to the bell cup 24.

Figure 3:
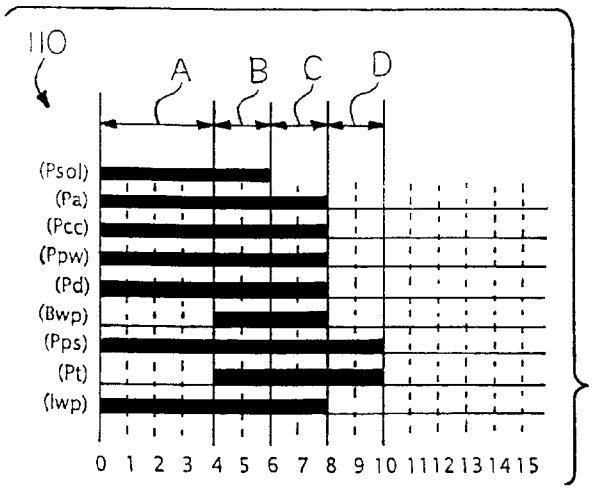
FIG. 3 is timing chart of the various control signals generated in the fluid delivery system shown in FIG. 2.

FIG. 3 is a timing chart 110 of the signals shown in the FIG. 2 during a color change sequence. A horizontal axis represents elapsed time divided into consecutive segments or periods beginning at a time point "0" and ending at a time point "15". The color change sequence proceeds in phases as follows: 1) from the time point "0" to the time point "4" is a "clean to home" phase A; 2) from the time point "4" to the time point "6" is a "clean at home" phase B; 3) from the time point "6" to the time point "8" is a "dry" phase C; and 4) from the time point "8" to the time point "10" is a "fill" phase D. The phase A is preferably conducted when the coating sequence is completed and the robot arm is moving the spray head 20 and robot wrist 28 to a "home" location (not shown) from which the next painting sequence will begin. The phase B, the phase C, and the phase D are preferably conducted when the spray head 20 and robot wrist 28 are at the "home" location. During the phases A and B, the various components of the spray head 20 are cleaned. The various components of the spray head 20 are dried in the phase C, and the same paint or the new color paint is loaded into the system to the spray head 20 in the phase D.

Along the vertical axis of the timing chart 110 are the control signals Psol, Pa, Pcc, Ppw, Pd, Bwp, Pps, Pt, and Iwp and horizontally extending bars indicate the time segments during which the associated valves 60, 62, 74, 84, 58, 102, 104, 96 and 90 respectively during the color change sequence. At the beginning of the phase A at the time point "0", the control signal Psol opens the solvent valve 60, the control signal Pa opens the air valve 62, the control signal Pcc opens the color changer valve 74, the control signal Ppw opens the pump wash valve 84, the control signal Pd opens the dump valve 58, the control signal Pps opens the fluid supply valve 104, and the control signal Iwp opens the injector wash valve 90. The pressurized solvent from the solvent valve 60 and the compressed air from the air valve 62 create a solvent/air mixture (not shown), which is used for cleaning during the color change sequence. During the phase A, the color changer supply line 46, the pump means 48, and the fluid line 54 are all flushed with the solvent/air mixture.

At the beginning of the phase B at the time point "4", the valves opened during the phase A remain open. In addition, the control signal Bwp opens the bell wash valve 102 and the control signal Pt opens the trigger valve 96. The solvent/air mixture, therefore, is flushed through not only the color changer supply line 46, the pump means 48, and the fluid line 54, but the atomizing bell cup 24 is flushed internally through the trigger valve 96 and the injector line 98, and cleaned externally through the bell wash valve 102.

At the beginning of the phase C at the time point "6", the valves opened during the phase B remain open with the exception of the solvent valve 60, which closes when the control signal Psol ends. Because the solvent valve 60 closes at the beginning of the phase C, compressed air only flows through the color changer supply line 46, the pump means 48, the fluid line 54, and the internal and external surfaces of the atomizing bell cup 24.

At the beginning of the phase D at the time point "8", the control signal Pa ends, closing the air valve 62, the control signal Pcc ends, closing the color changer valve 74, the control signal Ppw ends, closing the pump wash valve 84, the control signal Pd ends, closing the dump valve 58, the control signal Bwp ends, closing the bell wash valve 102, and the control signal Iwp ends, closing the injector wash valve 90. The control signals Pps and Pt continue, keeping the fluid supply valve 104 and the trigger valve 96 open until the time point "10". During the phase D, a selected one of the paint valves 42 is opened to provide the spray head 20 a fresh supply of a different color paint from the pump means 48.

Figures 4, 5:
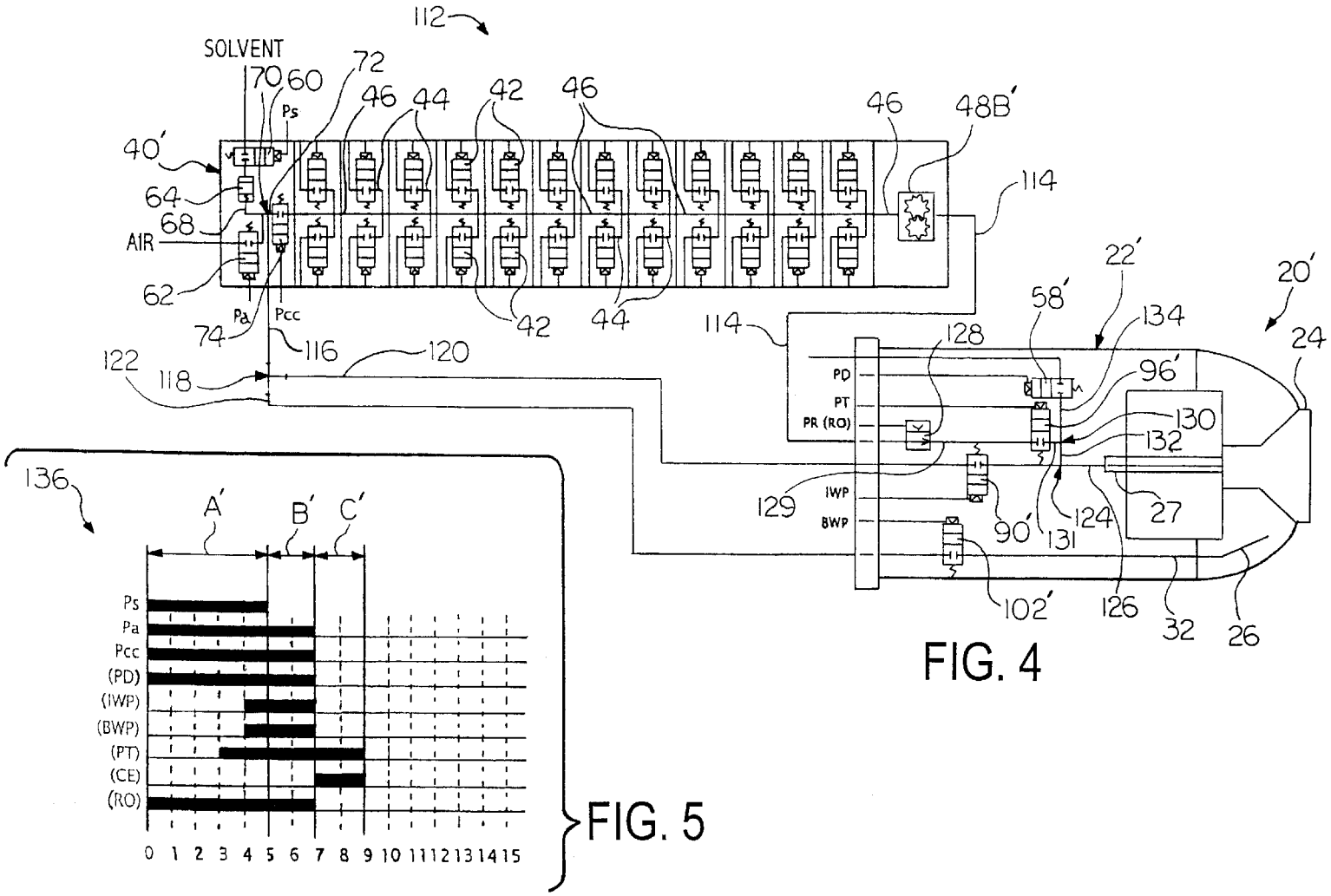
FIG. 4 is a schematic representation of the bell atomizer spray head shown in the FIG. 1 connected to a second embodiment fluid delivery system.
FIG. 5 is timing chart of the various control signals generated in the fluid delivery system shown in FIG. 4.

Referring now to FIG. 4, a second embodiment of a fluid delivery system is shown generally at 112. Like components are designated with the same reference numerals as in FIG. 2 and similar components are designed with the same reference numeral primed. The fluid delivery system 112 includes a fluid manifold housing 40' having a plurality of the fluid valves 42 with the outlets 44 connected to the color changer supply line 46. The color changer supply line 46 is connected an inlet of a positive displacement flow meter 48B' having a fluid line 114 connected between the meter outlet and the inlet of a spray head 20' for supplying fluid to the spray head.

Also included in the fluid manifold housing 40' are the solvent valve 60, the air valve 62, the solvent injector flow controller 64, the cleaning line 68, the tee coupling 70, the tee branch 72 and the color changer valve 74 all connected in the same manner as shown in FIG. 2. A cleaning line 116 is connected the stem of the tee 72 and extends to a branch of another tee coupling 118. A stem 120 of the tee 118 to an inlet of the spray head 20', and another branch 122 is connected to another inlet of the spray head 20'. The tee stem 120 is connected to an inlet of an injector wash valve 90'. An actuating signal IWP is provided to open and close the injector wash valve 90'. An outlet of the injector wash valve 90' connects to a branch of another tee 124 with another branch connected by an injector line 126 to the paint supply line 27 of the atomizing bell cup 24. The branch 122 of the tee 118 connects to an inlet of a bell wash valve 102'. An actuating signal BWP is provided to open and close the bell wash valve 102'. An outlet of the bell wash valve 102' is connected to the shaping air supply line 32 and the shaping air passages 30 for washing an outer surface of the atomizing bell cup 24. Alternatively, the outlet of the bell wash valve 102' extends to the cleaning passages 36 for washing an outer surface of the atomizing bell cup 24.

The fluid line 114 is connected to an inlet of a remotely piloted fluid pressure regulator 128 within the atomizer housing 22'. An actuating signal PR is a remotely controlled pneumatic pilot which sets the outlet pressure of the fluid regulator. The regulator override (RO) condition sets the fluid regulator 128 to its highest operating setting. An outlet of the regulator 128 is connected to an inlet of a trigger valve 96'within the atomizer housing 22'. An actuating signal PT is provided to open and close the trigger valve 96'. An outlet of the trigger valve 96' extends to a stem of a tee coupling 130 within the atomizer housing 22'. A branch 132 of the tee 130 is connected to a stem of the tee 124. Another branch 134 of the tee 130 extends to an inlet of a dump valve 58' within the atomizer housing 22'. An actuating signal PD is provided to open and close the dump valve 58'. An outlet of the dump valve 58' extends to an outlet from the spray head 20', which preferably extends to a fluid reclamation system (not shown). The actuating signals RO, PT, and PD are preferably supplied by compressed air.

The color change sequence is shown in a chart 136 of FIG. 5 that begins at a time point "0" and ends at a time point "15". At the time point "0", the coating sequence (not shown) has ended, and the color change sequence begins. The color change sequence 136 proceeds in phases as follows: 1) from the time point "0" to the time point "5" is a "clean" phase A'; 2) from the time point "0" to the time point "7" is a "dry" phase B'; and 3) from the time point "7" to the time point "9" is a "fill" phase C'. During the phase A', the various components of the spray head 20' are cleaned. The various components of the spray head 20' are dried in the phase B', and the fluid line 114 is primed in the phase C'.

The control signals Ps, Pa, Pcc, PD, IWP, BWP, PT and RO are provided to open the valves 60, 62, 74, 58', 90', 102', 96' and control the regulator 128 respectively during the color change sequence 136. At the beginning of the phase A' at the time point "0", the control signal Ps opens the solvent valve 60, the control signal Pa opens the air valve 62, the control signal Pcc opens the color changer valve 74, the control signal PD opens the dump valve 58', and the control signal RO overrides the regulator 128. At the time point "3", the control signal PT opens the trigger valve 96'. At the time point "4", the control signal IWP opens the injector wash valve 90', and the control signal BWP opens the bell wash valve 102'. The solvent valve 60 and the air valve 62 create a solvent/air mixture (not shown), which is used for cleaning during the color change sequence. Between the time points "0" and "3", the color changer supply line 46, the flow meter 48B', and a fluid line 129 connecting an outlet of the regulator 128 to an input of the trigger valve 96' are all flushed with the solvent/air mixture. Between the time points "3" and "4", the color changer supply line 46, the pump means 48', and a fluid line 131 connected between an outlet of the trigger valve 96' and the tee stem 132 are flushed with the solvent/air mixture. Between the time points "4" and "5", the solvent/air mixture is flushed through not only the color changer supply line 46, the flow meter 48B', and the fluid lines 114, 128, 131, and 132, but the atomizing bell cup 24 is also flushed internally through the trigger valve 96' and the injector line 126, and cleaned externally through the bell wash valve 102'.

At the beginning of the phase B' at the time point "5", the valves opened during the phase A' remain open with the exception of the solvent valve 60, which closes when the control signal Ps ends. Because the solvent valve closes at the beginning of the phase B', compressed air only flows through the color changer supply line 46, the flow meter 48B', the fluid line 114, to the internal and external surfaces of the atomizing bell cup 24.

At the beginning of the phase C' at the time point "6", the control signal Pa ends, closing the air valve 62, the control signal Pcc ends, closing the color changer valve 74, the control signal PD ends, closing the dump valve 58', the control signal BWP ends, closing the bell wash valve 102', the control signal IWP ends, closing the injector wash valve 90', and the control signal RO ends, stopping the override of the regulator 128. The control signal PT continues, keeping the trigger valve 96' open until the time point "9". The control signal CE opens one of the fluid valves 42 at the time point "7", priming the fluid line 114 with a fresh supply of fluid from the supply system and through the flow meter 48B'.

In accordance with the provisions of the patent statutes, the present invention has been described in what is considered to represent its preferred embodiment. However, it should be noted that the invention can be practiced otherwise than as specifically illustrated and described without departing from its spirit or scope. For example, while the present invention has been described with compressed air actuating signals, the present invention contemplates that the actuating signals are electronic or hydraulic signals.

What is claimed is:

1. A method of cleaning an exterior surface of a bell cup in a rotary atomizer spray head comprising the steps of:

a. providing at least one outlet in a shaping air assembly of a rotary atomizer spray head, said one outlet being positioned adjacent an exterior surface and an outer edge of a bell cup of the rotary atomizer spray head;

b. mixing pressured air and a cleaning solvent to produce a pressured air/solvent mixture; and c. supplying the pressured air/solvent mixture to the one outlet to clean the exterior surface and the outer edge of the bell cup.

2. The method according to claim 1 wherein the one outlet is an outlet of one of a plurality of shaping air passages each having an outlet positioned adjacent the exterior surface and the outer edge of the bell cup and an inlet, and further supplying the pressured air/solvent mixture to the inlets to clean the exterior surface and the outer edge of the bell cup and to clean the outlets of the shaping air passages.

3. The method according to claim 1 wherein the one outlet is an outlet of a cleaning passage formed in the shaping air assembly and having an inlet for receiving the pressured air/solvent mixture.

4. The method according to claim 3 wherein the step a. includes providing a plurality of shaping air passages each having an outlet positioned adjacent the exterior surface and the outer edge of the bell cup and an inlet, and further supplying the pressured air/solvent mixture to the inlets to clean the exterior surface and the outer edge of the bell cup.

5. The method according to claim 1 wherein the one outlet is an outlet of one of a plurality of cleaning passages formed in the shaping air assembly and each having an outlet positioned adjacent the exterior surface and the outer edge at the bell cup and an inlet, and further supplying the pressured air/solvent mixture to the inlets to clean the exterior surface and the outer edge of the bell cup.

6. The method according to claim 1 wherein the step c. includes connecting an outlet of a valve to the one outlet, supplying the pressured air/solvent mixture to an inlet of the valve and opening and closing the valve.

7. An apparatus for cleaning an exterior of a bell cup in a bell atomizer spray head comprising:

a bell cup having an exterior surface terminating in an outer edge;

a shaping air assembly having an end surface adjacent said exterior surface and outer edge of said bell cup;

at least one passage formed in said shaping air assembly having an inlet at one end and an outlet at an opposite end formed in said end surface; and a valve having an outlet connected to said one passage inlet and having an inlet whereby when a pressured air/solvent mixture is applied to said valve inlet and said valve is actuated to open, the pressurized air/solvent mixture is applied to said exterior surface and said outer edge of said bell cup.

8. The apparatus according to claim 7 wherein said passage is a shaping air passage formed in said shaping air assembly.

9. The apparatus according to claim 7 wherein said passage is a cleaning passage formed adjacent to but separate from a shaping air passage formed in said shaping air assembly.

10. The apparatus according to claim 7 wherein said passage is a cleaning passage and including a shaping air passage formed in said shaping air assembly having an inlet at one end and an outlet at an opposite end formed in said end surface, and wherein said valve outlet is connected to said shaping air passage inlet.

11. A method of cleaning an exterior surface of a bell cup in a rotary atomizer spray head comprising the steps of:

a. providing at least one outlet in a shaping air assembly of a rotary atomizer spray head, said one outlet being positioned adjacent an exterior surface and an outer edge of a bell cup of the rotary atomizer spray head;

b. mixing pressured air and a cleaning solvent to produce a pressured air/solvent mixture;

c. applying the pressured air/solvent mixture to an interior surface of the bell cup; and d. supplying the pressured air/solvent mixture to the one outlet to clean the exterior surface and the outer edge of the bell cap.

12. The method according to claim 11 wherein the step c. and the step d. are terminated at substantially the same time.

* * * * *